United States Patent [19]

Hanson et al.

[11] Patent Number: 4,849,097

[45] Date of Patent: Jul. 18, 1989

[54] CAM ACTUATED MINERAL JIG

[75] Inventors: Raymond A. Hanson; Wayne Crockett, both of Spokane, Wash.

[73] Assignee: R. A. Hanson Company, Inc., Spokane, Wash.

[21] Appl. No.: 126,342

[22] Filed: Nov. 30, 1987

[51] Int. Cl.[4] ..... B03B 5/10

[52] U.S. Cl. ..... 209/425; 209/504; 74/54; 74/568 R

[58] Field of Search ..... 209/455, 426, 456, 503, 209/504, 425; 74/54, 568, 26

[56] References Cited

U.S. PATENT DOCUMENTS

| | | | |
|---|---|---|---|
| 152,806 | 7/1874 | Montague | 74/54 |
| 215,090 | 5/1879 | Bridewell | 74/22 R |
| 290,855 | 12/1883 | Campbell | 74/54 |
| 760,664 | 5/1904 | Van Der Valk | 209/446 |
| 882,512 | 3/1908 | Woodbury | 209/504 |
| 1,638,864 | 4/1925 | Mathe et al. | 209/446 |
| 3,682,304 | 8/1972 | Seidel | 209/443 |
| 3,703,237 | 11/1972 | Cohen-Alloro et al. | 209/504 |

FOREIGN PATENT DOCUMENTS

| | | | |
|---|---|---|---|
| 11455 | 8/1887 | United Kingdom | 74/54 |
| 918848 | 2/1963 | United Kingdom | 74/54 |

OTHER PUBLICATIONS

IHC Holland Brochure, "High-Recovery Jigs".

M&W Tool Co., Inc. Brochure, "The American Balanced Jig".

*Primary Examiner*—Andres Kashnikow

*Assistant Examiner*—Mark T. Le

*Attorney, Agent, or Firm*—Wells, St. John & Roberts

[57] ABSTRACT

A mechanical drive mechanism is designed for imparting pivotal motion to the frame arm or walking beam of a mineral jig. Rotary cam action is employed to mechanically pivot the walking beam or frame arm which supports a cone and flexible diaphragm at one end for imparting jigging action to the jig bed. Adjustment features are preferably provided to enable the amplitude of the reciprocating motion imparted to the diaphragm and cone to be selectively varied. In the preferred embodiment, the cam is constructed to be pivotal when at rest for enabling the amplitude of the camming action, and correspondingly the pivot stroke, to be varied.

15 Claims, 6 Drawing Sheets

20
14
28
26
24
35
27
33
32
31
49
30
37
46
47
45
44
40

CAM ACTUATED MINERAL JIG

TECHNICAL FIELD

This invention relates to jigs.

BACKGROUND OF THE INVENTION

Jigging is one of the oldest methods for concentrating ores and is still widely used. It is a gravimetric method of concentration which utilizes differences in the densities of wanted and unwanted materials to effect their separation. In jigging, water is strongly pulsed upward and downward through a suspended bed of particles. After sufficient pulsation, the top portion of the bed becomes an accumulation of the lighter gangue, which can be rejected, while the lower portion contains the heavier enriched concentrate.

Typical jigs use a jig tank which is open at its top and bottom ends. The top of the jig tank includes a perforated, tapered, and inclined chute through which the material being separated flows to the tank. Oversized material is prevented from entering the jig tank by the perforated screens, and caused to flow down the tapered portion of the chute to be discharged from the jig. Water pulsations within the jig also cause the gangue to collect in the upper portions of the jig tank and flow from the jig out the discharge end of the chute. The lower portion of the jig tank is angled inwardly and joins with a vertically movable cone by means of a fluid-tight flexible diaphragm. The movable cone is typically mounted to a pivotal frame arm, commonly referred to as a walking beam, which is pivotally driven to generate the pulsations within the tank.

This invention relates to a simpler and more reliable mechanical drive for imparting pivotal motion to the pivotal frame arm or walking beam.

BRIEF DESCRIPTION OF THE DRAWINGS

Preferred embodiments of the invention are illustrated in the accompanying drawings, in which.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

Figure 1:
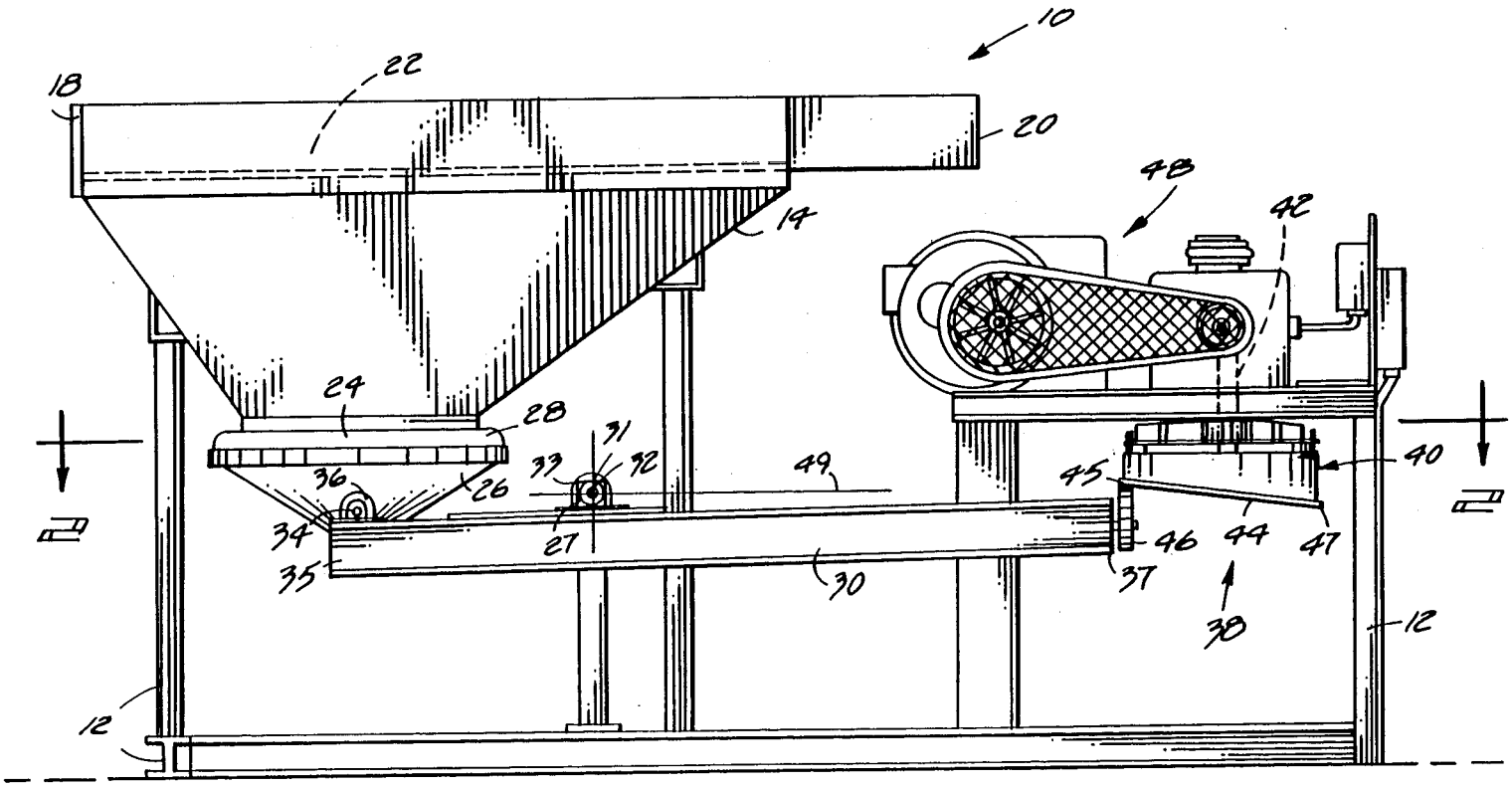
FIG. 1 is a side elevational view of a mineral jig in accordance with the invention.
Figure 2:
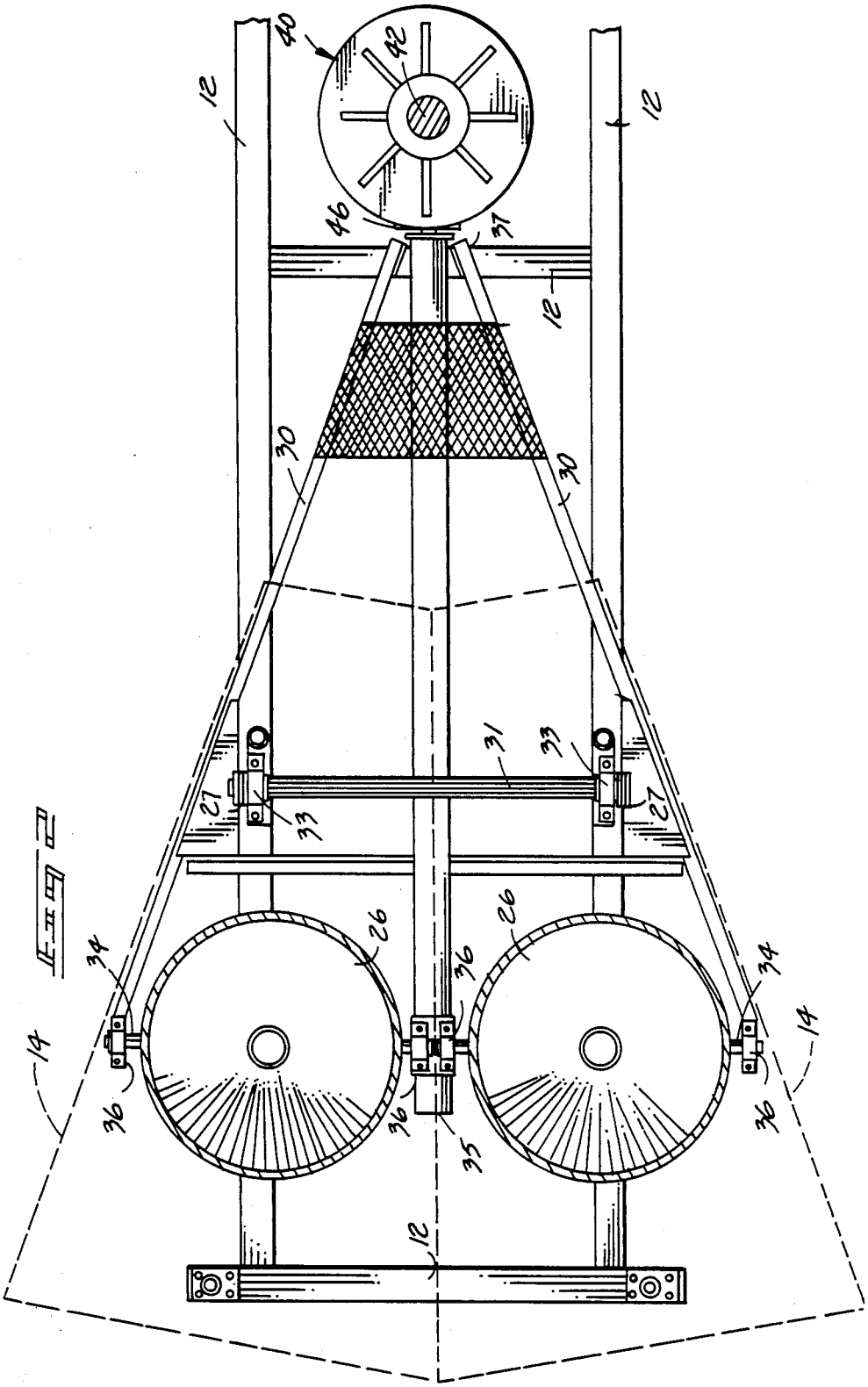
FIG. 2 is an enlarged cross-sectional view taken along line 2—2 in FIG. 1.

Referring to FIGS. 1 and 2, a jig in accordance with the invention is indicated generally by reference numeral 10. Jig 10 includes a base or supporting framework 12 which supports the various jig components. Framework 12 supports a pair of adjacent jig tanks 14 which retain water and the ore being concentrated. The upper end of each tank 14 is open and trapezoidal in cross-sectional shape, tapering outwardly from an intake end 20 to a discharge end 18. A screen 22 extends from the narrower intake end 20 of each tank top to the wider discharge end 18 causing any oversize material to flow toward the discharge end of the jig. The substantial lower portion of each tank 14 tapers inwardly to an open bottom end 24. A movable cone 26 is positioned beneath and covers each open bottom end 24. A flexible rubber diaphragm 28 interconnects each movable cone 26 with bottom end 24 of each tank 14, and provides a fluid-tight seal between tank 14 and cone 26.

A pivotal frame or walking beam 30 is mounted to supporting framework 12 for pivotal movement about a frame pivot axis 32. Frame pivot axis 32 is defined by a shaft 31 which is pivotally supported by a pair of bearings 33 mounted to supporting framework 12. A pair of support brackets 27 extend upwardly from frame 30 and engage shaft 31. Pivotal frame 30 is substantially triangular in shape having a wide end 35 and a narrow end 37. Movable cones 26 are supported at wide end 35. Each cone 26 is pivotally supported relative to frame 30 by a shaft 34 which is mounted thereto by a pair of roller bearings 36. It will be apparent that pivotal motion of pivot frame 30 about frame pivot axis 32 will impart vertical reciprocating motion to cones 26 relative to tanks 14 as facilitated by the flexible nature of diaphragm 28.

In accordance with the invention, a rotary cam drive means 38 is provided to impart pivotal motion to pivotal frame 30. Rotary cam drive means 38 includes a rotary cam assembly 40 which is mounted to a vertically oriented drive shaft 42. Drive shaft 42 is driven by means of an electric drive and reduction assembly 48. Cam 40 includes an axial cam surface 44 formed about its axial rim. Surface 44 is variably displaced axially relative to drive shaft 42 from a minimal displacement location 45 to a maximum displacement location 47. Surface 44 is positionally displaced above the narrow end 37 of pivotal frame 30. Cam 40 converts rotation of drive shaft 42 into a reciprocal motion of a selected amplitude to impart a pivotal motion to pivotal frame 30.

A roller 46 is rotationally mounted in a lateral orientation relative to pivotal frame 30 at its narrow end 37. Roller 46 rotationally engages cam surface 44 of rotary cam 40. It functions as a cam follower means for following the axial reciprocal motion imparted by rotary cam 40 to convert rotational motion of cam 40 into pivotal motion of frame 30 of a selected amplitude about frame pivot axis 32. Roller 46 is constantly biased upwardly against cam surface 44 the result of the greater mass of pivotal frame 30 and the weight of cones 26 to the left of frame pivot axis 32, as illustrated in the figures.

Figure 3:
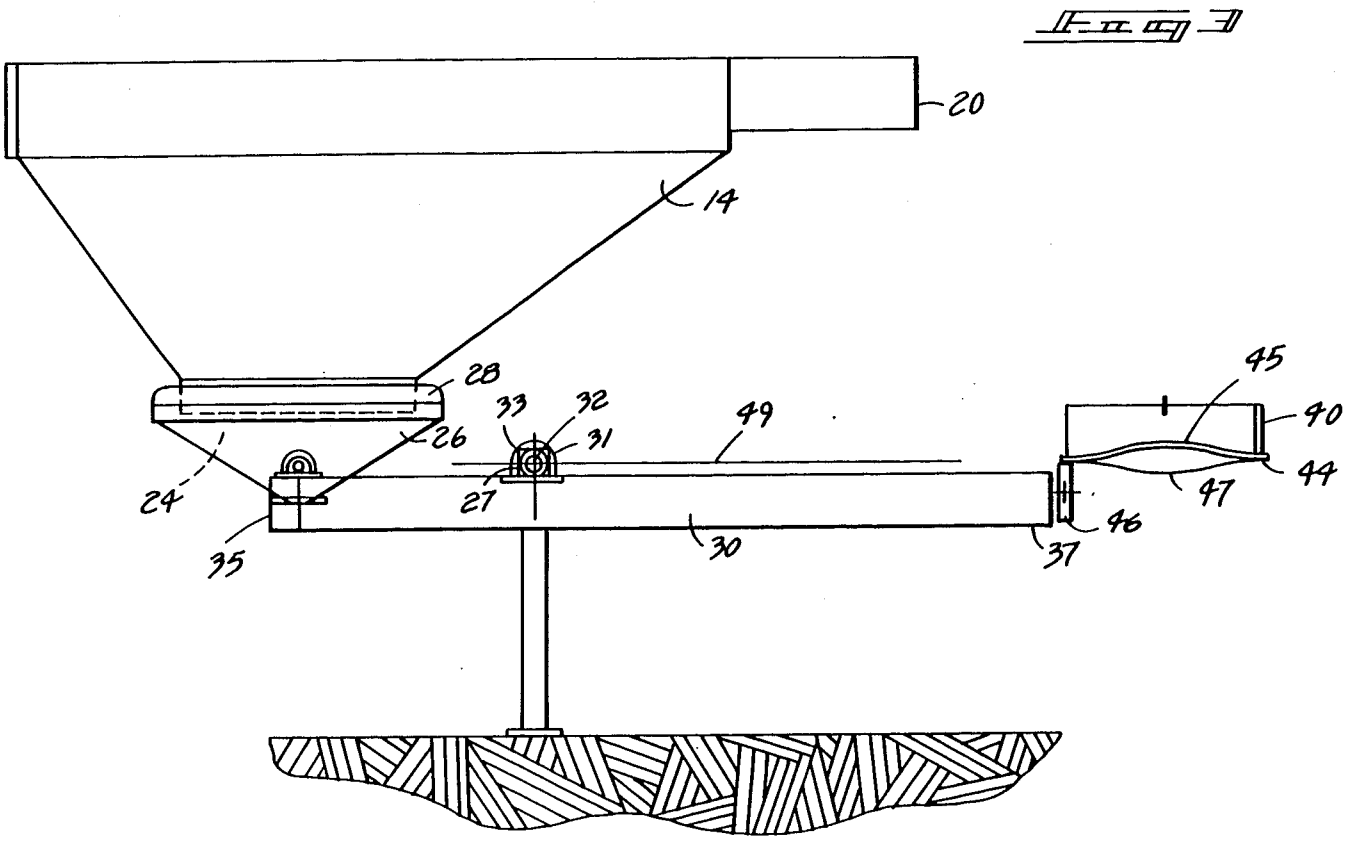
FIG. 3 is a diagrammatic and fragmentary side elevational view illustrating a different operational orientation of pertinent jig components from that illustrated in FIG. 1.
Figure 4:
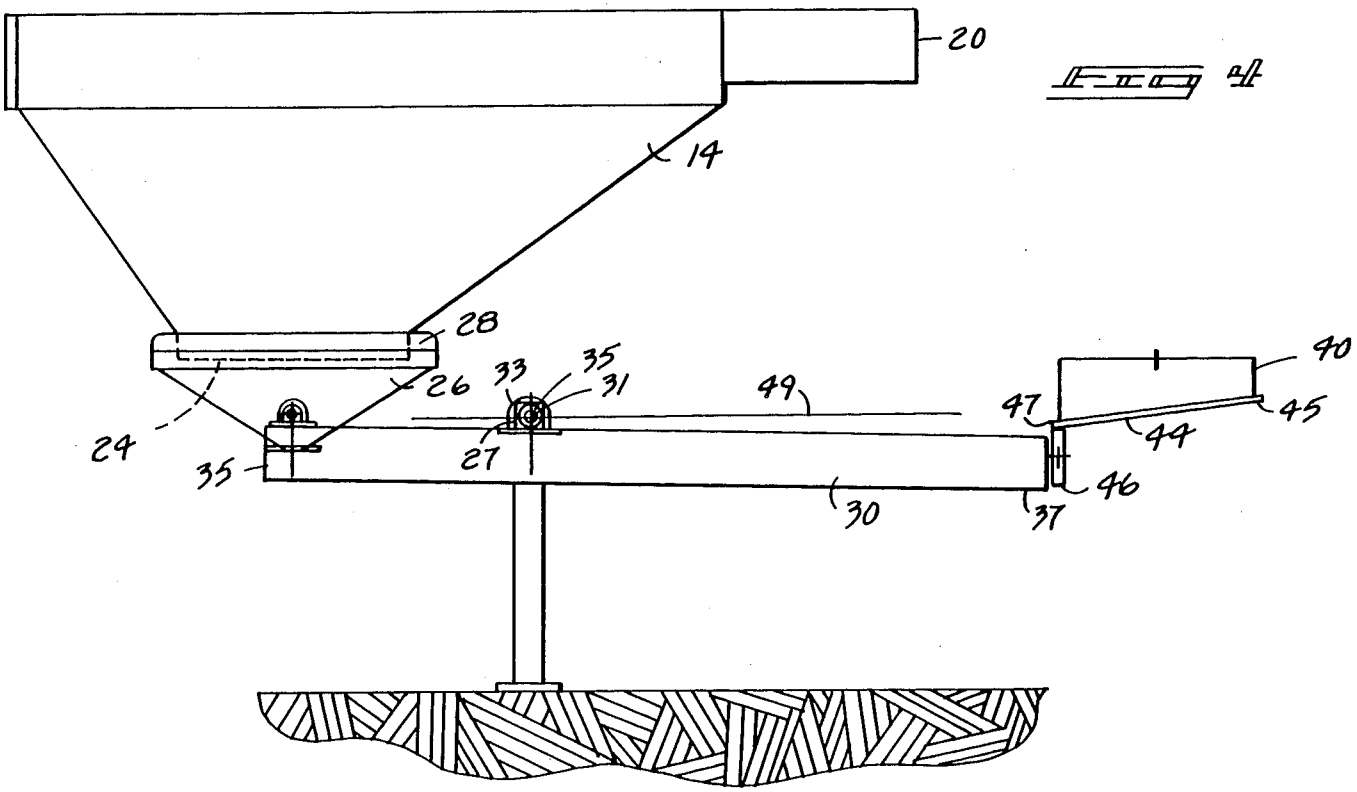
FIG. 4 is another diagrammatic and fragmentary side elevational view illustrating yet another operational configuration of pertinent jig components different from that shown in FIGS. 1 and 3.

FIGS. 1, 3 and 4 illustrate various positions of cam 40, pivotal frame 30, and cones 26 at various positions upon rotation of cam 40. FIG. 1 illustrates the configuration of the various jig components in a resting state. The weight of pivotal frame 30 and cones 26 result in full downward extension of flexible diaphragms 28 and pivoting of narrow end 37 of pivotal frame 30 to its maximum upward position. This forces roller 46 against cam 40 causing cam 40, and correspondingly drive shaft 42, to rotate to the point where narrow end 37 of pivotal frame 30 is restrained at its uppermost position. Accordingly, the jig always returns to this configuration upon disruption of power to drive assembly 48.

FIG. 3 diagrammatically illustrates the configuration of pertinent jig components when cam 40 has been caused to rotate ninety degrees in the overhead counter-clockwise direction (alternately, two hundred seventy degrees in the clockwise direction) relative to that shown in FIG. 1. In this position, cam surface 44 bearing against roller 46 has caused end 35 of pivotal frame 30 and movable cones 26 to be pivoted upwardly relative to tanks 14. Roller 46 engages cam surface 44 at the mid-axial displacement location from the minimum and maximum displacements 45, 47 respectively, and thus positions pivotal frame 30 horizontally. (Line 49 represents horizontal.)

As cam 40 is caused to rotate another ninety degrees in the counter-clockwise direction (FIG. 4), maximum axial displacement portion 47 of surface 44 bears against roller 46 and correspondingly pivots end 35 of pivotal frame 30 and cones 26 to their upwardmost position relative to tanks 14. Continued rotation of cam 40 results in repeated pivoting motion being imparted to pivotal frame 30 and correspondingly reciprocating motion to cones 26.

Cam surface 44 is preferably shaped or configured to provide a rapid upstroke and a slower downstroke of cones 26 relative to tanks 14. Additionally, although an axial cam surface is disclosed for imparting pivoting motion to pivotal frame 30, an alternate cam surface might be employed. For example, a horizontally oriented drive shaft could support a cam having a radial cam surface to impart the desired reciprocating motion to end 37 of pivotal frame 30. Accordingly, alternate cam configurations and cam surface profiles would be usable without departing from the principles and scope of the invention.

Figure 5:
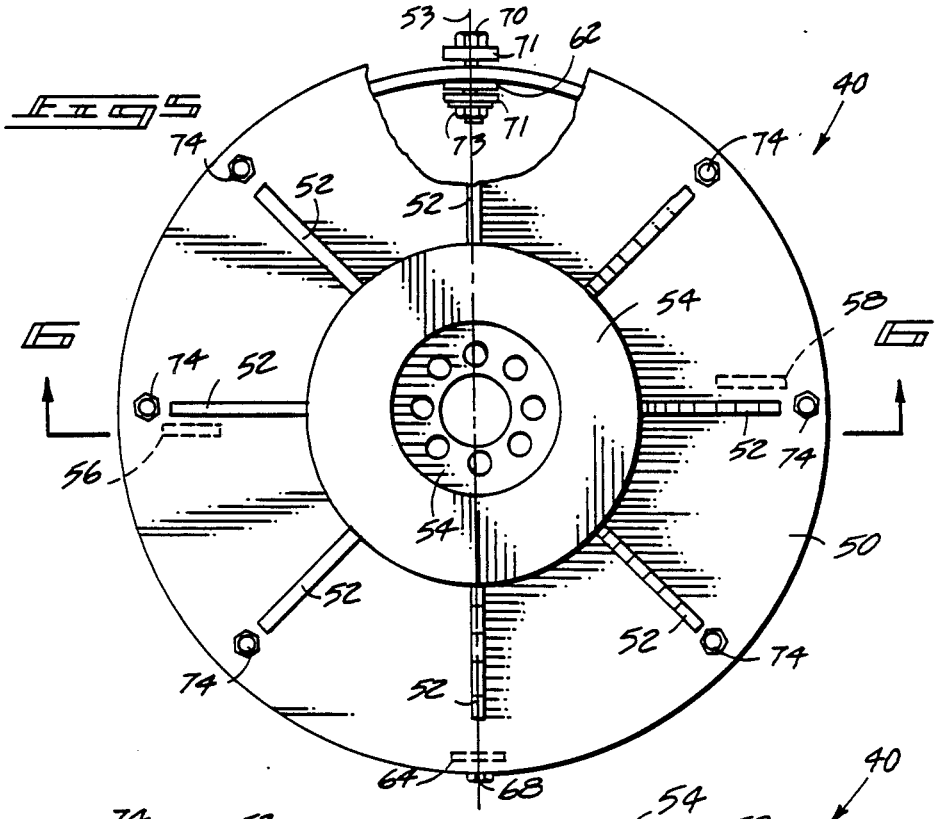
FIG. 5 is an enlarged top detail view of the rotary cam assembly of the jig shown in FIG. 1.
Figure 6:
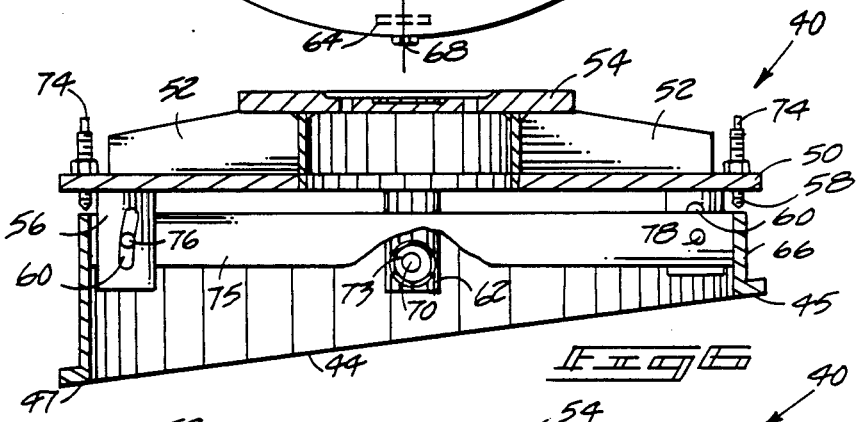
FIG. 6 is a cross-sectional view taken along line 6—6 in FIG. 5.
Figure 7:
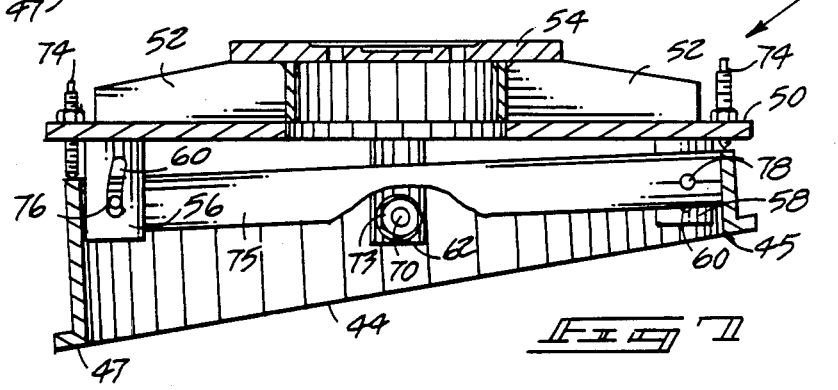
FIG. 7 is a similar cross-sectional view as would appear through line 6—6 in FIG. 5 with the rotary cam configured in an alternate operational configuration.

Jigs constructed in accordance with the invention also preferably include adjustment means for varying the amplitude of the reciprocating motion imparted to the movable cones. FIGS. 5–7 are enlarged detail views of cam assembly 40 of jig 10 illustrating one embodiment of such an adjustment means. The adjustment means functions by enabling variation of the selected amplitude of the reciprocal motion imparted by rotation of the cam as is more fully described below.

Cam assembly 40 includes a circular plate 50 having a plurality of upwardly projecting reinforcing fins 52 spaced thereabout. A tubular with end flange coupling assembly 54 extends upwardly from the center of plate 50 for coupling with drive shaft 42 (not shown in FIGS. 5–7). A pair of radially opposed extensions 56, 58 project downwardly from the underneath side of circular plate 50. Each of extensions 58 includes an arcuate slot 60. Displaced ninety degrees from each extension 56, 58 are radially opposed support extensions 62, 64 which also project downwardly from circular plate 50.

A circular rim-like cam component 66 is positioned beneath plate 50 and connects thereto by a pair of radially opposed, co-axial support bolts or shafts 68, 70. Each shaft 68, 70 extends through one of support extensions 62, 64 extending from plate 50. In this manner, component 66 is pivotally mounted relative to plate 50 (and correspondingly the cam drive shaft) for pivotal movement about a cam bisecting pivot axis 53. This enables the axial displacement of cam surface 44 relative to the drive shaft to be varied.

Cam component 66 includes a diametrically bisecting bar 75 which extends perpendicular to cam pivot axis 53. Radial opposed ends of bar 75 include oppositely projecting pins 76, 78 which are each slidably received within one of arcuate slots 60 of plate projections 56, 58. Shafts 68, 70 each receive a pair of washers 71 and a nut 73 for lockably engaging projections 62, 64 to enable positioning of cam component 66 relative to main plate 50. A series of six bolt and nut assemblies 74 thread through main plate 50 and engage the upper rim surface of cam component 66 to lockably fix or hold the axial displacement of the cam surface 44 relative to main plate 50 as cam assembly 40 rotates.

FIG. 7 illustrates cam component 66 positioned to impart a near maximum reciprocal movement relative to pivotal frame 30 for each rotation of cam assembly 40. FIG. 6 illustrates the mid-displacement position. The minimum displacement position would be provided by configuring cam component 66 in the pivot position opposite to that shown in FIG. 7. Such a cam structure provides a simpler and more reliable variable drive mechanism than is provided by prior art jigs.

Figure 8:
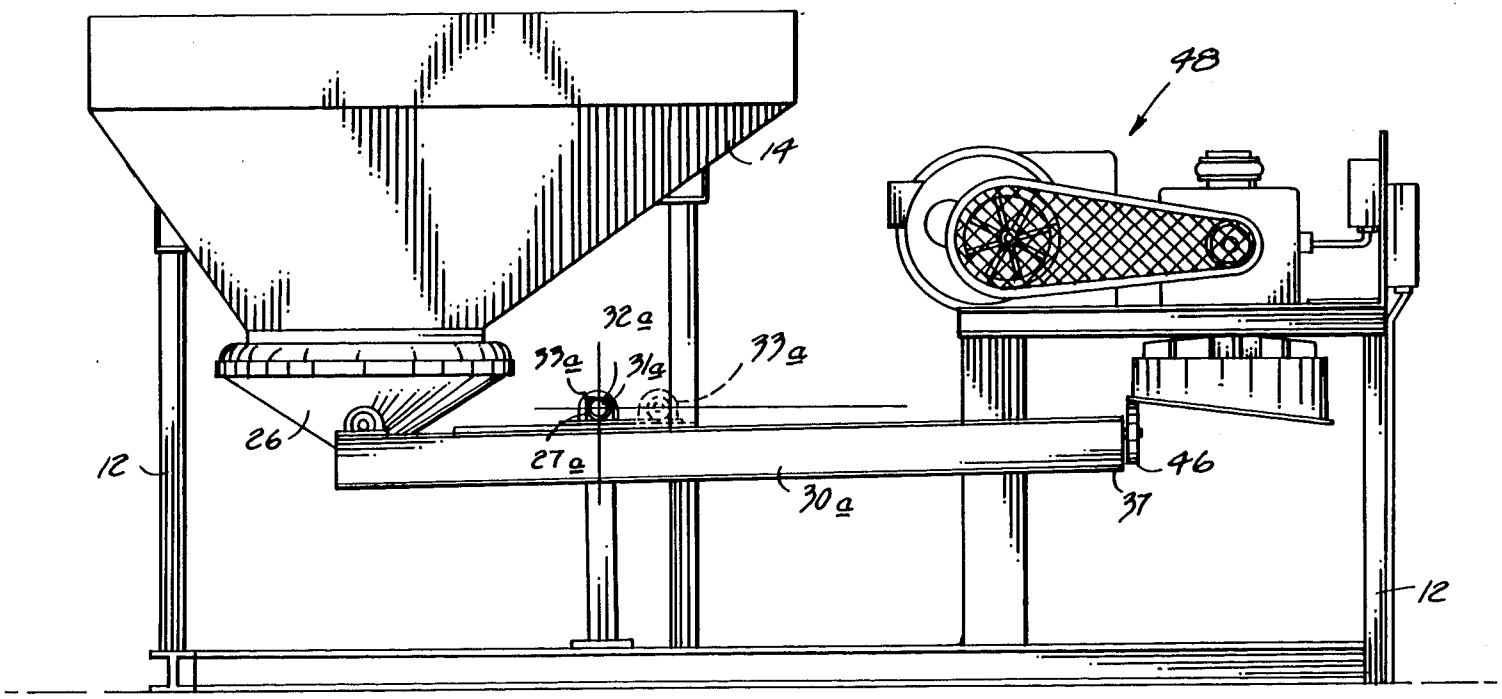
FIG. 8 is a side elevational view of an alternate embodiment mineral jig in accordance with the invention.

Alternate adjustment means could also be employed for enabling the amplitude of the reciprocating motion imparted to movable cones 26 to be varied, as illustrated by way of example only in FIG. 8. FIG. 8 illustrates a configuration whereby frame pivot axis **32*a* is position adjustable relative to supporting framework 12 generally along the longitudinal length of such framework and pivotal frame 30*a*. Bearings 33*a* are slidably mounted relative to framework 12 and lockable in various positions. Brackets 27*a* which engage pivot shaft 31 are slidably mounted relative to pivotal frame 30. In this manner, the position of pivot axis 32*a* can be varied along a portion of pivotal frame 30. Variability of frame pivot axis 32*a* will result in variation of the reciprocating stroke of movable cones 26. Movement of frame pivot axis 32*a* to the right, as shown in phantom in FIG. 8, will result in greater reciprocating motion being imparted to cones 26. Movement of frame pivot axis 32*a* to the left will result in lesser reciprocating motion being imparted to movable cones 26**.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A jig comprising:

a supporting framework;

at least one jig tank which retains water and material being concentrated, the jig tank having an open bottom end;

a movable cone positioned adjacent the open bottom end of the jig tank;

a flexible diaphragm interconnecting the movable cone and jig tank bottom end, the flexible diaphragm providing a substantially fluid-tight seal between the tank and cone;

pivotal frame means operably connected to the movable cone for imparting reciprocating motion to the movable cone relative to the jig tank, the pivotal frame means being mounted to the supporting framework for pivotal movement about a frame pivot axis;

rotary cam drive means for converting rotational motion into reciprocal motion of a selected amplitude, the rotary cam drive means including a rotary cam mounted to a drive shaft, the drive shaft being rotationally mounted relative to the supporting framework at a location adjacent the pivotal frame means, the rotary cam having a variably displaced cam surface;

cam follower means rotationally mounted and permanently fixed at a position relative to the pivotal frame means adjacent one of its ends and rotationally engaging the cam surface of the rotary cam for following the reciprocal motion imparted by the rotary cam drive means to convert rotational motion of the rotary cam into pivotal motion of the pivotal frame means of a selected amplitude about the frame pivot axis; and adjustment means for varying the selected amplitude of reciprocating motion imparted to the movable cone by the rotary cam drive means through the pivotal frame means.

2. The jig of claim 1 wherein the cam follower means includes a roller which is biased against the cam surface by the pivotal frame means.

3. The jig of claim 1 wherein the cam surface is an axial cam surface which is axially oriented relative to the drive shaft, the reciprocal motion imparted by the rotary cam being in an axial direction relative to the drive shaft.

4. The jig of claim 1 wherein the adjustment means comprises:

the frame pivot axis comprising a position adjustable frame pivot axis which is selectively movable relative to the supporting framework along the pivotal frame means.

5. A jig comprising:

a supporting framework;

at least one jig tank which retains water and material being concentrated, the jig tank having an open bottom end;

a movable cone positioned adjacent the open bottom end of the jig tank;

a flexible diaphragm interconnecting the movable cone and jig tank bottom end, the flexible diaphragm providing a substantially fluid-tight seal between the tank and cone;

pivotal frame means operably connected to the movable cone for imparting reciprocating motion to the movable cone relative to the jig tank, the pivotal frame means being mounted to the supporting framework for pivotal movement about a frame pivot axis;

rotary cam drive means for converting rotational motion into reciprocal motion of a selected amplitude, the rotary cam drive means including a rotary cam mounted to a drive shaft, the drive shaft being rotationally mounted relative to the supporting framework at a location adjacent the pivotal frame means, the rotary cam having a variably displaced cam surface, the cam surface being an axial cam surface which is axially oriented relative to the drive shaft, the reciprocal motion imparted by the rotary cam being in an axial direction relative to the drive shaft;

cam follower means rotationally mounted to the pivotal frame means adjacent one of its ends and rotationally engaging the cam surface of the rotary cam for following the reciprocal motion imparted by the rotary cam drive means to convert rotational motion of the rotary cam into pivotal motion of the pivotal frame means of a selected amplitude about the frame pivot axis; and adjustment means for varying the selected amplitude of reciprocating motion imparted to the movable cone by the rotary cam drive means through the pivotal frame means, wherein, the rotary cam drive means is pivotally mounted relative to the drive shaft for pivotal movement about a cam pivot axis, and the rotary cam drive means is lockable in fixed pivotal positions relative to the drive shaft, to enable axial displacement of the cam surface relative to the drive shaft to be varied.

6. The jig of claim 5 wherein the cam follower means includes a roller which is biased against the cam surface by the pivotal frame means and movable cone.

7. The jig of claim 5 wherein the cam pivot axis diametrically bisects the rotary cam.

8. The jig of claim 5 wherein, the cam follower means includes a roller which is biased against the cam surface by the pivotal frame means and movable cone; and the cam pivot axis diametrically bisects the rotary cam.

9. A jig comprising:

a supporting framework;

at least one jig tank which retains water and material being concentrated, the jig tank having an open bottom end;

a movable cone positioned adjacent the open bottom end of the jig tank;

a flexible diaphragm interconnecting the movable cone and jig tank bottom end, the flexible diaphragm providing a substantially fluid-tight seal between the tank and cone;

pivotal frame means operably connected to the movable cone for imparting reciprocating motion to the movable cone relative to the jig tank, the pivotal frame means being mounted to the supporting framework for pivotal movement about a frame pivot axis;

rotary cam drive means for converting rotational motion into reciprocal motion of a selected amplitude, the rotary cam drive means including a rotary cam mounted to a drive shaft, the drive shaft being rotationally mounted relative to the supporting framework at a location adjacent the pivotal frame means, the rotary cam having a variably displaced cam surface;

cam follower means rotationally mounted to the pivotal frame means adjacent one of its ends and rotationally engaging the cam surface of the rotary cam for following the reciprocal motion imparted by the rotary cam to convert rotational motion of the rotary cam into pivotal motion of the pivotal frame means of a selected amplitude about the frame pivot axis; and adjustment means for varying the selected amplitude of reciprocating motion imparted to the movable cone by the rotary cam drive means through the pivotal frame means, each of the cam follower means and rotary cam drive means including a roational axis, the rotational axes of the cam follower means and rotary cam drive means being perpendicular to one another.

10. The jig of claim 9 wherein:

the cam surface is an axial cam surface which is axially oriented relative to the drive shaft, the reciprocal motion imparted by the rotary cam being in an axial direction relative to the drive shaft; and the adjustment means comprises:

the rotary cam drive means being pivotally mounted relative to the drive shaft for pivotal movement about a cam pivot axis, and being lockable in fixed pivotal positions relative to the drive shaft, to enable axial displacement of the cam surface relative to the drive shaft to be varied.

11. The jig of claim 10 wherein the cam follower means includes a roller which is biased against the cam surface by the pivotal frame means and movable cone, and wherein the cam pivot axis diametrically bisects the rotary cam.

12. A jig comprising:

a supporting framework;

at least one jig tank which retains water and material being concentrated, the jig tank having an open bottom end;

a movable cone positioned adjacent the open bottom end of the jig tank;

a flexible diaphragm interconnecting the movable cone and jig tank bottom end, the flexible diaphragm providing a substantially fluid-tight seal between the tank and cone;

pivotal frame means operably connected to the movable cone for imparting reciprocating motion to the movable cone relative to the jig tank, the pivotal frame means being mounted to the supporting framework for pivotal movement about a frame pivot axis;

rotary cam drive means for converting rotational motion into reciprocal motion of a selected amplitude, the rotary cam drive means including a rotary cam mounted to a drive shaft, the drive shaft being rotationally mounted relative to the supporting framework at a location adjacent the pivotal frame means, the rotary cam having a variably displaced cam surface;

cam follower means rotationally mounted to the pivotal frame means adjacent one of its ends and rotationally engaging the cam surface of the rotary cam for following the reciprocal motion imparted by the rotary cam to convert rotational motion of the rotary cam into pivotal motion of the pivotal frame means of a selected amplitude about the frame pivot axis;

adjustment means for varying the selected amplitude of reciprocating motion imparted to the movable cone by the rotary cam drive means through the pivotal frame means; and the rotary cam drive means including a rotational axis, the rotary cam drive means and cam follower means engaging one another at an engagement location, and the relative positions between the rotational axis and the engagement location remaining substantially constant throughout rotation of the rotary cam drive means and remaining the same for all variations of the adjustment means.

13. The jig of claim 12 wherein:

the cam surface is an axial cam surface which is axially oriented relative to the drive shaft, the reciprocal motion imparted by the rotary cam being in an axial direction relative to the drive shaft; and the adjustment means comprises:

the rotary cam drive means being pivotally mounted relative to the drive shaft for pivotal movement about a cam pivot axis, and being lockable in fixed pivotal positions relative to the drive shaft, to enable axial displacement of the cam surface relative to the drive shaft to be varied.

14. The jig of claim 13 wherein the cam follower means includes a roller which is biased against the cam surface by the pivotal frame means and movable cone, and wherein the cam pivot axis diametrically bisects the rotary cam.

15. The jig of claim 12 wherein the cam follower means is positioned generally vertically relative to the cam surface and remains so positioned throughout all operational variations of the adjustment means.

* * * * *